United States Patent [19]

Ruffieux et al.

[11] 4,032,736

[45] June 28, 1977

[54] GAS-PRESSURIZED ELECTRICAL SWITCH WITH CURRENT-GENERATED MAGNETIC FIELD FOR ASSISTING ARC EXTINCTION

[75] Inventors: Stanislas Ruffieux, Baden; Ekkehard Schade, Wettingen, both of Switzerland

[73] Assignee: BBC Brown Boveri & Company Limited, Baden, Switzerland

[22] Filed: Aug. 6, 1975

[21] Appl. No.: 602,185

[30] Foreign Application Priority Data

Aug. 20, 1974 Switzerland ..... 11323/74

[52] U.S. Cl. ..... 200/147 R; 200/148 B

[51] Int. Cl.[2] ..... H01H 33/18

[58] Field of Search ..... 200/147, 147 A, 150 B, 200/148 B

[56] References Cited

UNITED STATES PATENTS

| | | | |
|---|---|---|---|
| 2,103,121 | 12/1937 | Slepian | 200/147 R |
| 2,140,378 | 12/1938 | Biermanns et al. | 200/147 R |
| 2,141,120 | 12/1938 | Whitney et al. | 200/147 R |
| 2,227,134 | 12/1940 | Hara | 200/150 B |
| 3,110,791 | 11/1963 | Aspey et al. | 200/150 B |

*Primary Examiner*—Robert S. Macon

*Attorney, Agent, or Firm*—Pierce, Scheffler & Parker

[57] ABSTRACT

A gas-pressurized electrical switch includes a casing provided with a transverse wall dividing the interior into two quenching chambers filled with a pressurized arc-quenching gas. A longitudinally movable contact member is supported within a first one of the chambers and includes a nozzle pipe projecting through the transverse wall into the other chamber for entry into an annular stationary contact member which is surrounded by a magnetic-field producing coil having one end connected to one terminal of the switch. The nozzle pipe is provided with apertures through the wall thereof in the first chamber which place the two chambers in communication with each other. A pin member is located centrally within the stationary contact member and is entered into the nozzle pipe in the contact-closed position, and this pin is surrounded by an annular electrode. When the contacts disengage, an arc is drawn and thereafter one portion of the arc burns between the annular electrode and the pin and is rotated by the magnetic field, and the other portion of the arc burns between the pin and the nozzle pipe of the movable contact member. Burning of the arc generates heat which causes an increase in gas pressure in the chamber containing the stationary contact member assembly which then acts to start flow of arc extinguishing gas through the nozzle pipe which results in arc extinction.

5 Claims, 1 Drawing Figure

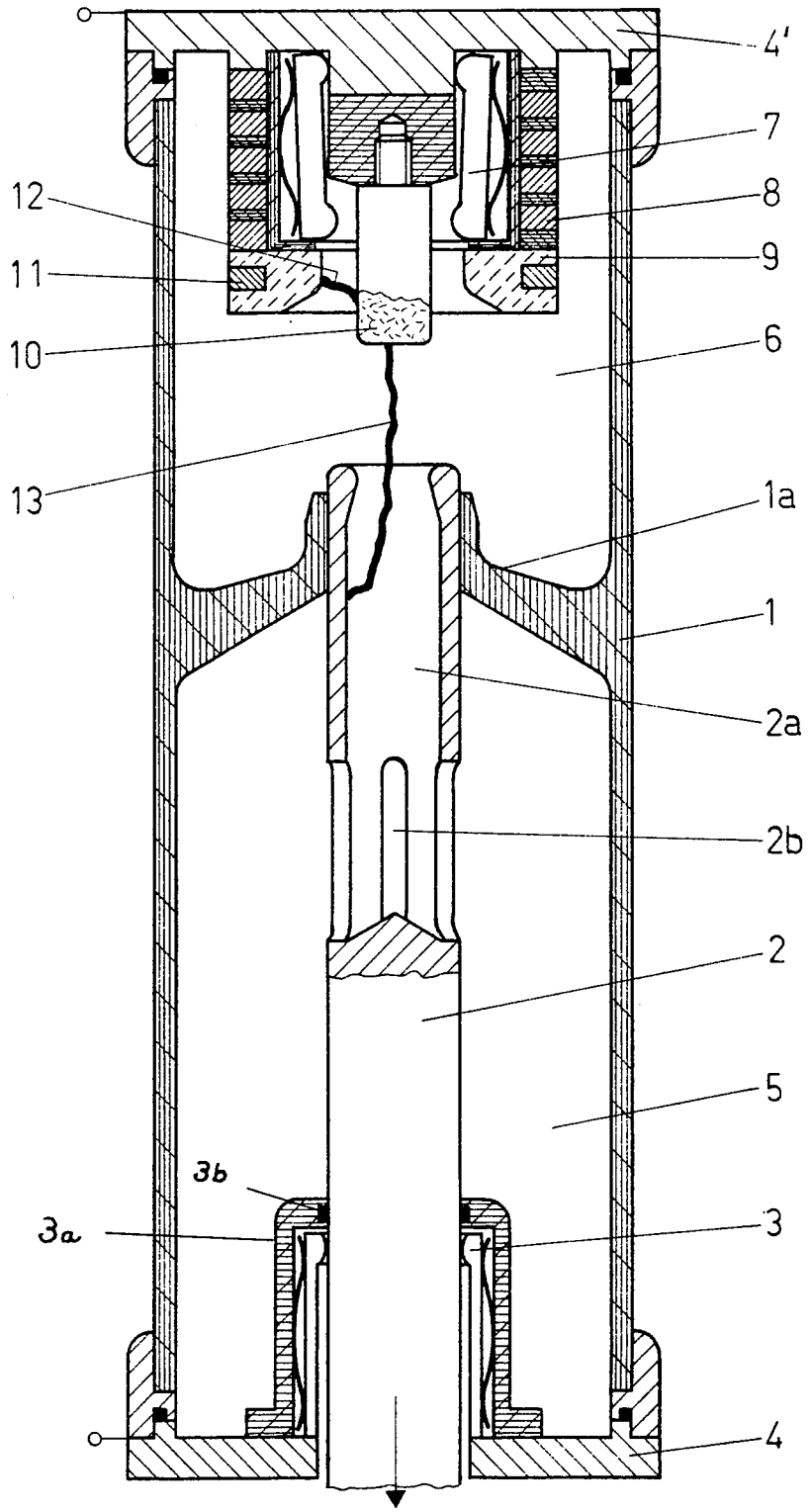
4'
7
8
9
12
11
10
6
13
1a
1
2a
2b
2
5
3b
3a
3
4

GAS-PRESSURIZED ELECTRICAL SWITCH WITH CURRENT-GENERATED MAGNETIC FIELD FOR ASSISTING ARC EXTINCTION

The present invention concerns an electric gas-filled switch where there is provided, in addition to a pressure, self-generated by the arc, an apparatus to influence the arc magnetically.

A gas pressurized switch, possessing a closed quenching chamber filled with $SF_6$, where the chamber contains switching components in one part of the chamber which is separated by a wall from another part of the chamber, is already known. The wall has openings for the passage of the pressurized gas, generated under the influence of the arc in the area containing the switching components. This switch is also equipped with a device to influence the arc magnetically by spinning it and by driving it toward the openings.

There is further known in view of published German patent application DT-AS No. 1 074 121 a switch where the quenching of the arc is accomplished by a flow of extinquishing medium, generated by the arc proper within a quenching chamber, where the arc is divided by an intermediate electrode at a specific extinguishing path into two parts thusly that one part of the arc will burn inside the quenching chamber as the pressure-generating arc, while the other part will appear at the overflow aperture of the chamber where it is quenched by the emerging extinguishing medium.

The principal object of this invention is to improve switches of the above described general type so far as their circuit-breaking capabilities are concerned and to simplify their construction at the same time, making such switches more economical.

The invention accomplishes this aim by the collective use of the following features:

a. the stationary switching contact member embraces an insulated, centrally placed electrically conductive pin, and is surrounded by a coil through which will flow the cut-off current, b. there is provided an annular intermediate electrode, electrically connected to one of the coil ends and surrounding the pin at a distance, c. the movable switching contact member is designed in the form of a nozzle pipe which embraces the pin when in the contact-closed position of the switch, d. the nozzle pipe contacts the arcing space in the switch chamber with another space into which the positive pressure of the filling gas, generated by the arc, will expand in the form of a blast flow.

The accompanying drawing depicts one practical example of the invention illustrated in longitudinal section.

With reference now to the drawing the movable switching contact member 2 enters the quenching chamber 1 under seals. The upper part of this contact member 2 is designed as nozzle pipe 2*a* and is provided with apertures 2*b*. The lower end of the contact member 2 is connected to a — not illustrated-standard drive for moving it towards and away from the stationary contact member 7. A group of contact fingers 3 surround and lie in contact with the periphery of the movable contact member 2. These fingers are supported within an insulated housing 3*a* with contact seal 3*b* secured to a conductive end cover flange 4 for one end of casing 1. Flange 4 is electrically connected to the contact fingers 3 and serves as one terminal connection for the switch. The contact member 2 is quided as its upper part within a partition wall 1*a* of the quenching chamber. This partition 1*a* divides the quenching chamber into two parts 5 and 6, with lower part 5, serving as the collection chamber for the switch gases, made substantially greater in volume thant the upper part 6. To the upper conductive cover flange 4' of the quenching chamber which serves as the other terminal connection, there is fastened the stationary switching contact member 7 designed in the shape of a tulip. The switching contact member 7 is surrounded by a coil 8, its upper end being electrically connected to the upper flange 4', and its lower end to an annular intermediate electrode 9. An electrically conductive pin 10 is insulatedly fastened centrically within the contact member 7 to the upper flange 4' and is surrounded by the electrode 9. It will be advantageous to manufacture pin 10 and electrode 9 at least partially from an arc-resistant material, preferably graphite if $SF_6$ is used as the gas filling the quenching chamber. Numeral 11 denotes a short circuit ring supported within a circumferential groove in the annular electrode 9. The quenching chamber is filled with pressurized $SF_6$ gas.

The apparatus operates as follows:

When in the make i.e. contact-closed position, the movable contact member 2 engages the stationary tulip-shaped contact 7. In order to break the circuit, the contact member 2 moves downardly in the direction of the arrow. An arc will occur, first between contact members 2 and 7, with the arc then commutating from contact 7 to the intermediate electrode 9, with the result that the cut-off current will flow through the coil 8, and that the arc will begin to rotate under the influence of the magnetic field produced by the coil. After a certain length of travel by the contact member 2 (the position shown in the drawing) the arc will divide. One part 12 will burn between the components 9 and 10, and the other part 13 between components 2a and 10. The part 12 of the arc will continue to rotate and generate, by heating up the gas filling chamber part 6, a positive pressure relative to the lower part 5 of the chamber. The extinguishing flow through the nozzle pipe 2*a*, 2*b*, started due to this difference in pressure, will extinguish the arc. The short circuit ring 11 causes a phase shift of the magnetic field relative to the field generating current, thus facilitating the quenching effect.

The novel arrangement is advantageous because its construction is simple and inexpensive. The outlay for the contact drive mechanism likewise can be kept to a minimum because there is no need for compression means and only a short travel is necessary for the switching components.

We claim:

1. In a gas pressurized electrical switch with a current generated magnetic field for assisting arc extinction the combination comprising a casing forming a quenching enclosure, said casing being provided with a transverse wall dividing the interior thereof into a pair of closed quenching chambers, a pressurized arc quenching gas filling said chambers, a longitudinally movable contact member located centrally in a first one of said chambers and which includes a nozzle pipe projecting through said transverse wall into the other quenching chamber, a stationary annular contact member mounted in said other quenching chamber opposite the nozzle pipe of said movable contact member for engagement therewith, the part of said nozzle pipe located in said first quenching chamber including openings through the wall which establish a communication between said quenching chambers, a stationary electrically conductive pin located centrally within said stationary contact member and electrically insulated therefrom, said pin being spaced radially from said stationary contact member so as to provide for passage therebetween of the nozzle pipe of said movable contact member, a magnetic-field producing coil surrounding said annular contact member and having one end thereof electrically connected to the same terminal member on said switch to which said stationary contact member is connected so as to carry the switch current after said contact members have disengaged, and an annular electrode electrically connected to the other end of said coil and which surrounds and is spaced from said pin, whereby following initial disengagement of said nozzle pipe from said stationary contact member a first arc is established between said annular electrode and said pin and a second arc is established from said pin to the internal surface of said nozzle pipe thereby effecting current flow through said coil and production of a magnetic field inducing rotation of said first arc and heating of said gas in said other chamber to increase its pressure and effect an arc extinguishing gas flow therefrom through said nozzle pipe and into said first chamber.

2. A gas-pressurized electrical switch as defined in claim 1 and which further includes an annular short circuit ring surrounding said pin.

3. A gas-pressurized electrical switch as defined in claim 2 wherein said annular ring is located in an annular slot provided in said annular electrode.

4. A gas-pressurized electrical switch as defined in claim 1 wherein said pin and said annular electrode are made at least partially of graphite.

5. A gas-pressurized electrical switch as defined in claim 1 wherein the pressurizing gas in said switch is sulphur hexafluoride ($SF_6$).

* * * * *